US005723800A

United States Patent [19]

Yoshimoto et al.

[11] Patent Number: 5,723,800

[45] Date of Patent: Mar. 3, 1998

[54] WEAR RESISTANT CERMET ALLOY VANE FOR ALTERNATE FLON

[75] Inventors: Takashi Yoshimoto; Yasushi Hara; Hirokuni Amano; Masao Koshi, all of Toyama, Japan

[73] Assignee: Nachi-Fujikoshi Corp., Toyama, Japan

[21] Appl. No.: 674,997

[22] Filed: Jul. 3, 1996

[30] Foreign Application Priority Data

Jul. 3, 1996 [JP] Japan ..... 7-187683

[51] Int. Cl.[6] ..... C22C 29/04

[52] U.S. Cl. ..... 75/238; 75/242

[58] Field of Search ..... 75/238, 242, 243, 75/244

[56] References Cited

U.S. PATENT DOCUMENTS

| | | | |
|---|---|---|---|
| 4,857,108 | 8/1989 | Brandt et al. | 75/238 |
| 4,985,070 | 1/1991 | Kitamura et al. | 75/238 |
| 5,336,292 | 8/1994 | Weinl et al. | 75/230 |
| 5,395,421 | 3/1995 | Weinl et al. | 75/238 |
| 5,421,851 | 6/1995 | Oskarsson et al. | 75/238 |
| 5,462,574 | 10/1995 | During et al. | 75/238 |

FOREIGN PATENT DOCUMENTS

| | | |
|---|---|---|
| 56-47550A | 4/1981 | Japan . |
| 61-48556A | 3/1986 | Japan . |
| 64-32087 | 2/1989 | Japan . |
| 64-35091 | 2/1989 | Japan . |
| 2-102392 | 4/1990 | Japan . |
| 3-18682A | 1/1991 | Japan . |
| 6-33256A | 2/1994 | Japan . |

*Primary Examiner*—Ngoclan Mai
*Attorney, Agent, or Firm*—Spencer & Frank

[57] ABSTRACT

According to the present invention there is provided a wear resistant vane for alternate flow that is appropriate for a rotary compressor that employs HFC flow as an alternate refrigerant, and which vane possesses: a reciprocal or opposed characteristic in that it does not cause to wear a piston to which it contacts and nevertheless causes little wear to itself; a preferable corrosion resistance; and an ensured reliability, in that when employed for an operation that continues for an extended period of time there is no possibility of a surface layer suddenly peeling off. The present invention discloses a vane made of a wear resistant cermet alloy for alternate flow, comprising: 5 to 20% by weight of a binder phase composed mainly of Ni; a hard phase having a double phase structure having a core composed mainly of titanium carbide, titanium nitride and/or titanium carbonitride, and a rim phase encircling the core; and inevitable impurities; the hard phase containing 30 to 60% by weight of Ti, 10 to 30% by weight of W, 0.5 to 10% of Mo, 1 to 25% by weight of at least one of Ta, Nb, Cr, V and Zr, 2 to 5.4% by weight of N and 4 to 12% by weight of C, and being uniformly dispersed in an alloy phase; and further, an average core size of the core being 1.5 μm or less and a maximum core size of the core being 5 μm or less.

4 Claims, 2 Drawing Sheets

WEAR RESISTANT CERMET ALLOY VANE FOR ALTERNATE FLON

BACKGROUND OF THE INVENTION

1. Field of the Invention

The present invention relates to a wear resistant cermet alloy vane for alternate flon that is appropriate for a compressor, such as a rotary compressor or a vane pump, and especially for a rotary compressor that employs alternate flon as a refrigerant.

2. Related Arts

FIG. 2 PRIOR ART is a schematic block diagram illustrating a fluid circuit for a conventional rotary compressor in which a wear resistant vane is to be employed. A cermet alloy vane of the present invention is provided as an improved vane that is appropriate for use for such a rotary compressor. A vane 1 is constantly pressed against a piston 2 by a spring 3, and serves as a partition board which defines two spacial areas in a cylinder 4 without causing a leakage between them. As the changes of the volumes of the two spacial areas that are defined by the piston 2 and the cylinder 4 as a consequence of the eccentric rotation of the piston 2, a gas (a refrigerant) is repeatedly drawn in and expelled out under pressure alternately. As the piston 2 rotates around a fixed shaft 10, the cylinder 4 reciprocates in the direction indicated by the arrow 11 in response to the force of the reaction transmitted by the vane 1, which is pressed by the spring 3, so that the piston 2 constantly slides along the internal face of the cylinder 4. Conventionally, fluorocarbon gas is used as the refrigerant.

Bearing in mind the conditions under which the compressor must operate in order to provide a continuous preferable performance, it can be seen that since the distal end of the vane is in constant close contact with the piston, and since it slides through, and its sides closely contact with the sides of the cylinder, a necessary property required for the vane is that it possess excellent resistance to wear, i.e., that there be little wear of the vane itself, while at the same time causing little wear of the piston and the cylinder that it contacts, i.e., that the material of the vane has a negligibly aggressivity relative to other materials. To provide increased lubrication, Alkylbenzene-base lubricating oil, for example, which is compatible with fluorocarbon gas, is employed to till the compressor. In such a lubrication environment, in order to ensure a continuous and preferable operating condition, it is necessary for the vane and the piston to adapt themself to each other and to possess excellent self-lubricating capabilities respectively. Therefore, it is important that the friction coefficient between the vane and the piston is low. A high friction coefficient between them will not only degrade their self-lubricating properties, but also increase the temperature of the lubricating oil, which can cause the generation of carboxylic acid and of the corrosion and wear of the vane material. Thus, the requirements for the compressor are that the wear incurred by the vane itself is small, that the vane has a negligibly aggressivity relative to the piston and the cylinder, and that the friction coefficient between the vane and the piston is of small.

Conventionally, a high-speed steel, such as SKH51, which is plastically formed into a predetermined shape after ingot casting had been performed, or an Fe-base sintered alloy is used for the above described vane. A carbon is used when a reduction of the aggressivity of a material relative to other materials is taken into consideration, and a ceramic, such as $Al_2O_3$ or SiC, is employed in a high output power and of a wear resistant type of compressor. In order to enhance a wear resistant and self-lubricating property of a vane; an alloy vane having an evenly dispersed Fe-Cr-C hard phase is proposed in Japanese Unexamined Patent Publication No. Sho 56-47550; an Al-Si alloy vane is proposed in Unexamined patent Publication No. Sho 61-48556; and a light vane having a hollow section and a nitride layer deposited on the sliding surface is disclosed in Japanese Unexamined Patent Publication No. Sho 64-35091; and a porous Fe-base sintered vane is proposed in Japanese Unexamined Patent Publication No. Hei 2-102392. Further, a recently proposed vane using a high-speed steel as a mother alloy, and on the surface of which is formed with a hard coating layer, e.g., an Ni-P-plated layer, or an Ni-P-plated layer in which fluoric resin is dispersed. A vane using an AL-alloy as a mother alloy is disclosed in Japanese Unexamined Patent Publication Nos. Sho 64-32087 and Hei 3-18682; and a vane using a high-speed steel as a mother alloy is disclosed in Japanese Unexamined Patent Publication No. Hei 6-33256. A high strength nitrogen-containing cermet is disclosed in U.S. Pat. No. 4,985,070. However, since the ratio of Ni of its binding phase can be 50% or less, the material proposed herein is of highly corrosive, and thus is not appropriate for a wear resistant cermet alloy vane for alternate flon. In addition, since the N content which is 5.5 to 9.5 by weight % is extremely high, and an average core particle size and a maximum core particle size are not specified, a low aggressivity relative to other materials can not be acquired, and this material can not be employed for a wear resistant cermet alloy vane for alternate flon.

As a conventional refrigerant that is used for the above described compressor, commonly employed is a specific chloro fluorocarbon (hereinafter referred to as CFC) flon, especially, a specific flon called CFC-12 that has two chlorine (Cl) atoms. When CFC flon reaches the stratosphere, however, it is decomposed by ultraviolet rays and discharges Cl, resulting in the destruction of the ozone layer. Therefore, since in accordance with the Montreal protocol, it was internationally determined that CFC flon be totally abolished by 2004, the study of substitute refrigerants has been undertaken.

Among those substitute refrigerants, hydrofluorocarbon (hereinafter referred to as HFC) flon, especially, HFC-134a, or a refrigerant mixture that contains it, is deemed as the most favorable as this substitute flon refrigerant has an ozone destruction coefficient of 0. However, when the alternative HFC flon is used for a vane pump and a rotary compressor, compared with the conventional CFC flon, several problems arise, in that since the HFC flon does not contain chlorine, the lubrication effect of the refrigerant is degraded, in that the hygroscopicity of the refrigerant is high, and in that a load applied to a vane becomes large because it is necessary for a compressor to keep a high compression rate. Since alkylbenzene lubricating oil for CFC flon especially can not be used because it has not a phase-solubility with HFC alternate flon, ester oil that has a phase-solubility is used. However, ester oil has a low lubrication property and high hygroscopicity. Therefore, a problem arises in that hydrolysis occurs and carboxylic acid is generated, which results in an adverse influence, such as corrosive wear.

Taking the above problems into account, necessary properties that a vane must embody when HFC flon is used as an alternate flon are that the resistance to wear of the vane itself should be higher than that of the conventional vane because of high loads, that for a continuous operation without burning and scoring in a reduced lubrication environment the vane and the piston should highly adapt themself to each other, the friction coefficient should be low, and its self-lubrication property should be high (i.e., its aggressivity relative to other materials should be low), and that the material should possess an adequate corrosion resistance to acids, such as carboxylic acid, that are generated by the decomposition of ester lubricating oil. As for these matters, when HFC alternate flon is employed for the operation of a conventional vane made of a high-speed steel or made of a Fe-base sintered alloy, it has been proved that the wear incurred by such a vane itself becomes excessive due to its sliding against the piston, and finally scoring is caused. Therefore, the vane is not appropriate for practical use. Further, a vane made of a ceramic also has a shortcoming in that its aggressivity relative to other materials is great. As a vane material, carbon is itself susceptible to wear and weak. In addition, the above described vane on which a hard coating layer, such as an Ni-P-plated layer, is provided is not yet reliable in its resistance to peeling.

Recently, in contrast to the conventional vane material, a test has been conducted with a vane, for HFC alternate flon, wherein a hard coating layer that is formed of a nitride, such as a physical or chemical vacuum evaporated Ti or Cr nitride plated on a high-speed steel used as a mother material, was provided. Although this type of vane has so far a comparatively preferable characteristic, however, because of the coating layer, the vane can not reliably resist peeling and it has not been adopted for a practical use. As is described above, among the vanes that are in practical use for conventional CFC flon, or the vanes that have been studied for alternate HFC flon, the vanes for HFC alternate flon that we have realized up to date are shown in Table 1. Putting the vane of this invention aside, the remaining vanes have both merits and demerits, and are not satisfactory for practical use.

TABLE 1

Comparison table of vanes using HFC-base flon

| Vane Characteristics | High-speed Steel | Fe—Cr base sintering material | Ceramic ($Al_2O_3$-base SiC-base) | Carbon | Hard phase coating: Ni—P plating | Hard phase coating: CrN by PVD coating | Present invention cermet vane |
|---|---|---|---|---|---|---|---|
| Wear resistance | X | X | ◎ | X | ○ | ◎ | ◎ |
| Low aggressivity relative to others | ◎ | ◎ | X | ◎ | ○ | ○ | ○ |
| Low friction coefficient | X | X | Δ | X | ○ | ◎ | ◎ |
| Corrosion resistance | X | X | ◎ | ◎ | ◎ | ◎ | ◎ |
| Peeling resistance | ◎ | ◎ | ◎ | ◎ | X | X | ◎ |
| Total Evaluation | X | X | X | X | Δ | Δ | ◎ |

Note 1) ◎: Outstanding; ○: Excellent; Δ: Average or a little less than average; X: Extremely poor
Note 2) Evaluations are based on results of wear test conducted under the following conditions.
Load: 150 kgf
Oil temperature: 110° C.
Revolution count: 500 rpm
Loading time: 3 h
Pressure: 13.5 kgf/cm$^2$

SUMMARY OF THE INVENTION

It is therefore an object of the present invention is to provide a preferably wear resistant vane for alternate flon that is used for a rotary compressor, which employs, as an alternate refrigerant, HFC flon that has poor properties; such as a low lubrication capability, to be required a high-load operation, and possible corrosive wear due to the generation of carboxylic acid, and that possesses the required characteristics: a reciprocal or opposed characteristic in that it does not cause to wear a piston to which it contacts and nevertheless causes little wear to itself; a preferable corrosion resistance; and an ensured reliability, in that when employed for an operation that continues for an extended period of time there is no possibility of a surface layer suddenly peeling off.

More specifically, to achieve the above object, according to the present invention, there is provided a vane made of wear resistant cermet alloy for alternate flon comprising: 5 to 20% by weight of a binder phase composed mainly of Ni; a hard phase having a double phase structure having a core composed mainly of titanium carbide, titanium nitride and/or titanium carbonitride, and a rim phase encircling said core; and inevitable impurities; said hard phase containing 30 to 60% by weight of Ti, 10 to 30% by weight of W, 0.5 to 10% of Mo, 1 to 25% by weight of at least one of Ta, Nb, Cr, V and Zr, 2 to 5.4% by weight of N and 4 to 12% by weight of C, and being uniformly dispersed in an alloy phase; and further, an average core size of said core being 1.5 μm or less and a maximum core size of said core being 5 μm or less.

Referring to FIG. 1, which is a specific diagram illustrating the micro-structure of a wear resistant cermet alloy of the present invention, the cermet alloy comprises: a hard phase with a double phase structure having a core 22 composed mainly of titanium carbide, titanium nitride and/or titanium carbonitride, and a rim phase 28 encircling the core 22; and a binding phase 21 composed of Ni or Co as a primary component, and these micro-structure can take a delicate balance between wear resistance and toughness. The cermet alloy is practically used as a cutting tool material, especially in fields where wear resistance and toughness, and particularly thermal shock resistance are required in a high-speed cutting region of the alloy. In the present invention, a vane for alternate flon is provided which uses such a wear resistant cermet alloy.

A conventional vane of Fe-base or other materials, or a vane that has currently been developed for alternate flon, is insufficient and can not be practically used for a rotary compressor that employs alternate flon as a refrigerant, specifically HFC flon. On the other hand, since wear resistance is increased and aggressivity relative to other material is improved by the wear resistant cermet alloy vane for alternate flon of the present invention, the vane of the present invention can serve as a vane for a rotary compressor that employs an HFC flon refrigerant. In the vane of the present invention, titanium carbide, titanium nitride, and/or titanium carbonitride are uniformly and finely dispersed as a hard phase which is balanced with a binding phase composition. This cermet alloy structure is not only increases both a self-lubrication capability and prevents the scoring of a piston or a cylinder, but also the corrosion resistance becomes sufficiently high to prevent corrosion wear due to carboxylic acid which is generated by the decomposition of HFC flon lubricating oil. Further, when compared with a hard phase coated vane, since the hard phase is integrally formed, the vane of the present invention is reliable in its resistivity to peeling. As a result, the vane material of the present invention is the only vane material which can currently be practically used for HFC flon. Therefore, by employing the wear resistant cermet alloy vane of the present invention, a compressor can be practically used that employs as a refrigerant alternate flon complying with the environmental rules.

Preferably, the binding phase is composed of 5 to 10% by weight of Ni and Co as primary elements, and the ratio of Ni that is contained in the binding phase is 50% or larger by weight. With this composition, carbides of W, Mo, Ta, Nb or Cr solid-solute in go, causing a strain hardening of the binding phase, which affects the plastic strain of the binding phase, and contributes to the improvement of the strength and the wear resistance. More preferably, free carbide is crystallized in the cermet alloy. As a result, the friction coefficient is drastically reduced so as to increase self-lubrication capability, and the temperature rise of lubricating oil is prevented so as to restrict the generation of carboxylic acid.

DETAILED DESCRIPTION OF THE PREFERRED EMBODIMENT

Figure 1:
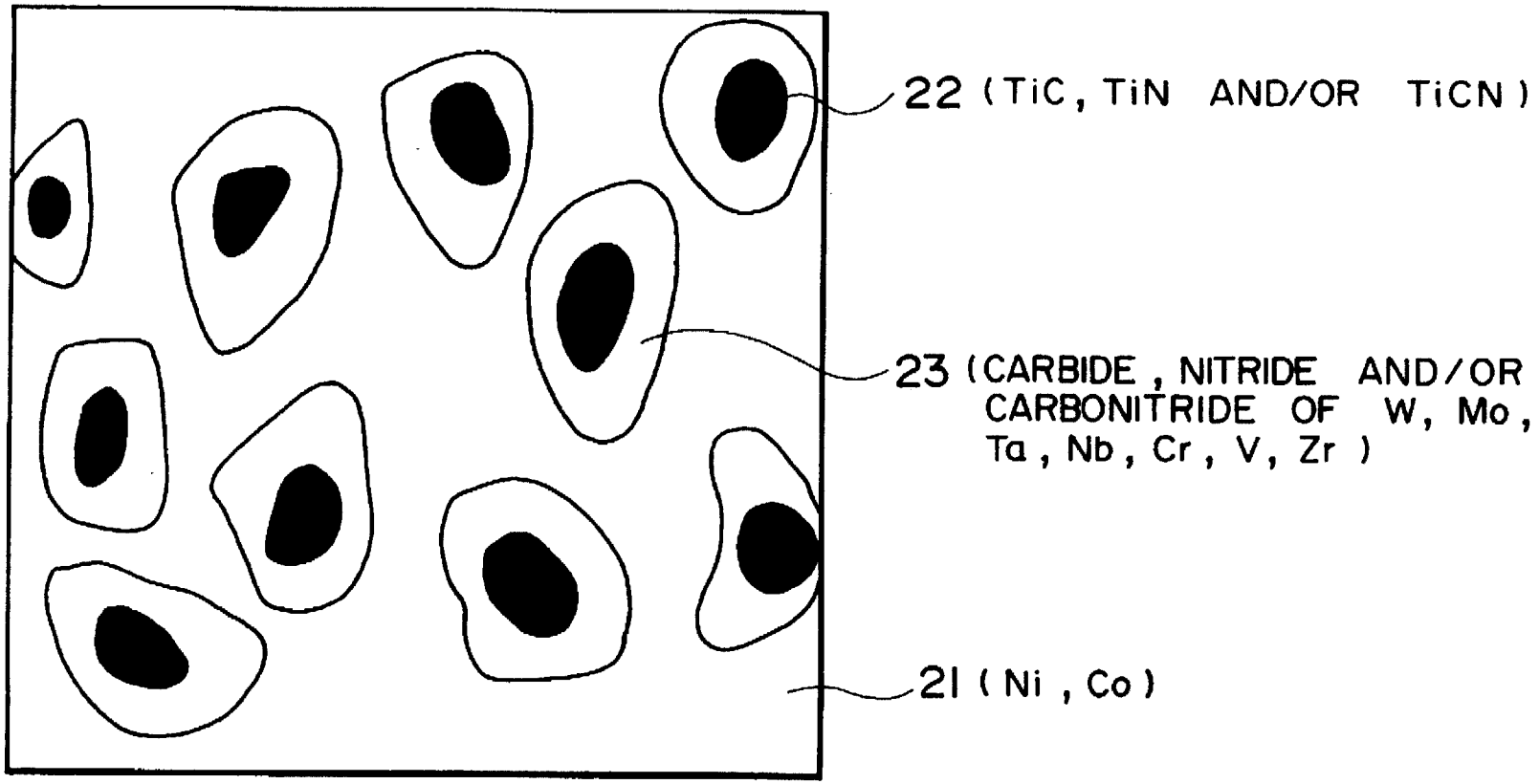
FIG. 1 is an enlarged specific diagram illustrating a micro-structure of a cermet alloy of the present invention.
Figure 2:
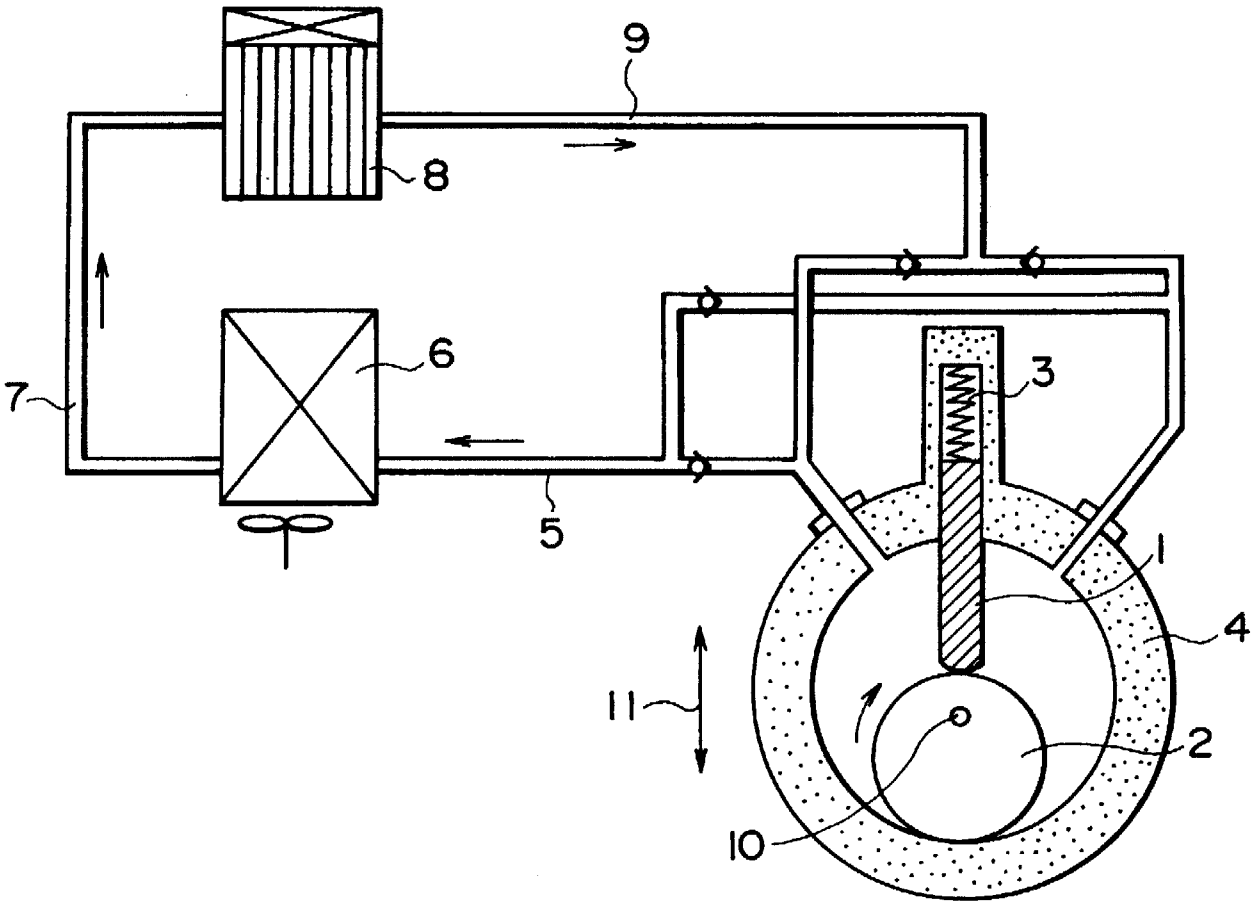
Fig. 2 PRIOR ART
FIG. 2 PRIOR ART is a schematic block diagram illustrating a fluid circuit for a conventional rotary compressor in which a wear resistant cermet alloy vane of the present invention may be employed.

In a compressor that uses HFC alternate flon are found the above described unfavorable conditions: a low lubrication capability; a high-load operation; and a possibility of corrosive wear due to the generation of carboxylic acid. Since the vane material of the present invention uses a cermet allot that contains nitride, its wear resistance and corrosion resistance are as high as those of ceramic, while its aggressivity relative to other materials is as low as carbon, the self-lubrication property of the vane is high, and the strength is not as low as that of ceramic or carbon but is sufficiently high which is the next to high-speed cutting tool steel in strength. Ti carbide is used as the core of the hard phase to acquire a wear resistance as high as that of ceramic, and as Ni is used for a binding phase which can cope with corrosion. Further, since nitride or carbonitride of Ti is contained in the hard phase, a friction coefficient is reduced, the self-lubrication property is increased, and the aggressivity relative to other materials is reduced. In addition, since the core particle size of the hard phase is specified to within a specific uniform and minute range, the other materials are prevented from being damaged by the dropping of the core particles of the hard phase, and an advanced Wear of the vane is prevented.

The performances of the individual elements of the cermet vane material of the present invention and the reasons for limiting the values thereof will now be explained.

(1) The amount of binding phase: The amount of the binding phase is inversely proportional to the amount of the hard phase, and establishes a balance between the wear resistivity and the toughness of an alloy. When the amount of the binding phase is less than 5% (by weight; the same is applied hereinafter), sintering of the material tends to be insufficient. Even with complete sintering, hardness of the material is excessive, and the resultant structure is highly aggressive relative to other materials, and is inappropriate for use as a vane material. When the amount of binding phase exceeds 20%, the hardness is reduced, and accordingly, the wear resistance is reduced, and further, in some cases, an adhesion of the binding phase metal occurs which results in burning. For these reasons, the amount for the binding phase is determined to be 5 to 20%.

(2) The composition of the binding phase: The strength and corrosion resistance of a cermet alloy are greatly affected by the binding phase. As a solid solution of carbides of W, Mo, Ta, Nb and Cr in Co causes strain hardening, affects the plastic strain of the binding phase, and contributes to the improvement of strength Co is corroded by acid, while Ni substantially is not. When the rate of Ni in a binding phase is less than 50%, the structure is greatly affected by the corrosion caused by carboxylic acid and is not appropriate for practical use, therefore, the lower limit for Hi is determined to be 50%.

(3) The amount of titanium (Ti): In addition to C and N, titanium carbide, titanium carbonitride, and titanium nitride are present in the hard phase. Among them, titanium carbide and titanium carbonitride contribute to the improvement of the wear resistance, and titanium nitride and titanium carbonitride contribute to increase the self-lubrication capability and to provide a finer structure of the hard phase in the alloy. When the Ti content is less than 30%, the wear resistance is inadequate, while when the Ti content exceeds 60%, the alloy is weakened and has increased an aggressivity relative to other materials. Thus, the range for the Ti element is determined to be 30 to 60%.

(4) The amount of W: This element acts to provide a fine structure for the hard phase and to strengthen the binding phase, and ensures the strength of the alloy. When the W content is less than 16%, the alloy is weakened. When the content of W exceeds 30%, a phenomenon occurs wherein an intermediate chemical compound is precipitated as a lower carbide, and the strength of the alloy is reduced. For these reasons, the W content is set to be between 10 to 30%.

(5) The amount of Mo: The Mo that is present in the hard phase acts to provide a uniform fine structure for the hard phase, increases the strength of the alloy, improves the sintering so as to .increase the binding force between the hard phase core and the binding phase, and prevents the hard phase core from falling off due to the friction when the alloy is slided. The above effects can not be obtained when the Mo content is less than 0.5%. With a Mo content of more than 10%, the rim phase becomes too thick and the hard phase is weakened so that the falling off of the core is caused. Thus, the range of Mo content is set to be 0.5 to 10%.

(6) The amounts of Ta, Nb, Cr, V and Zr: At least one of these metal elements form compound carbonitride with Ti, Mo and W, or provide an intermetallic compound, to increase the strength, the plastic deformation resistance and the heat resistance of the alloy. Ta and Nb contribute mainly to improve the heat resistance and the acid resistance of the alloy, and Cr contributes mainly to increase the corrosion resistance and the plastic deformation resistance. These effects are not obtained if the content of at least one of the above elements is less than 1%, while if the same exceeds 25%, the structure is weakened. Therefore, the range for the content of these element is set to be 1 to 25%.

(7) The amount of C (carbon): Together with the above described hard phase forming elements (Ti, Mo, W, Ta, Nb, Cr, V and Zr) C forms hard carbide or carbonitride to increase wear resistance and reduce scoring. Therefore, the C content is varied depending on the contents of the hard phase forming elements. When the amount of C is excessive, free carbon is crystallized or precipitated to reduce a friction coefficient. When the content of C is less than 4%, a weak intermetallic compound is generated as a lower carbide and the alloy is thus deteriorated. When the content of C is more than 12%, the amount of precipitated free carbon is increased and acts as an abrasive powder, which damages the other materials. Therefore, the range for element C is determined to be 4 to 12%.

(8) the amount of nitride (N): In the alloy structure, N exists in the form of nitride or carbonitride of Ti, and contributes to provide a finer structure of the hard phase core. Because of the toughness of nitride, N increases the toughness and also the self-lubrication capability. Since with an N content of less than 2% the hard phase core is not sufficiently minute and the self-lubrication capability is low, the core falls off during the sliding operation and cause a wear mark on the contacting piston. When the amount of N exceeds 5.4%, the hard phase is not as hard, and the wear resistance is reduced. For the above reasons, the N content is determined to be 2 to 5.4%.

(9) The core size in the hard phase: The sliding condition of a vane in a rotary compressor which is used in this embodiment, can be regarded as of a friction-wear characteristic in a so-called low friction speed area. Therefore, the wearing condition is that of a mechanically destructive wear, which can be that of an adhesion wear, an abrasive wear, and a dragging-out wear. Here, the abrasive wear mainly occurs as a result of the falling off of the hard phase cores. This is due to the weakness of the binding forces of between the hard phase and the binding phase, and to the hard phase itself. This problem is resolved by limiting the hard phase core size. The average core size of the hard phase cores is set to 1.5 μm or less and a maximum core size of the hard phase cores is set to 5 μm or less.

EXAMPLE 1

17 types of mother materials for vanes were prepared as is shown in Table 2.

TABLE 2

| | | | Alloy Elements (wt. %) | | | | | | | | | | | | | | | |
|---|---|---|---|---|---|---|---|---|---|---|---|---|---|---|---|---|---|---|
| Categories | No. | Sample | Fe | Ni | Co | Ti | W | Mo | Ta | Nb | Cr | V | Zr | Al | $Al_2O_3$ | C | N | Remarks |
| Vane materials of this invention | A | Cermet | — | 8.0 | 8.0 | 40.0 | 22.7 | 0.5 | 8.4 | — | — | — | — | — | — | 7.4 | 5.0 | |
| | B | Cermet | — | 4.0 | 1.0 | 56.0 | 10.0 | 7.0 | 6.0 | 1.0 | 1.0 | — | 1.0 | — | — | 9.0 | 4.0 | |
| | C | Cermet | — | 7.5 | 4.0 | 42.0 | 14.0 | 5.0 | 8.0 | 3.0 | — | 3.0 | — | — | — | 10.0 | 3.5 | |
| | D | Cermet | — | 13.0 | — | 38.0 | 30.0 | 3.5 | — | 3.0 | — | — | — | — | — | 10.0 | 2.5 | |
| | E | Cermet | — | 11.0 | — | 32.0 | 30.0 | 2.5 | — | 3.0 | — | — | — | — | — | 9.0 | 2.2 | |
| | F | Cermet | — | 16.0 | 4.0 | 40.0 | 15.0 | 1.0 | 4.0 | 4.0 | 2.0 | 1.0 | 1.5 | — | — | 8.0 | 3.5 | |
| | G | Cermet | — | 12.0 | — | 39.0 | 28.0 | 3.8 | — | 4.0 | — | — | — | — | — | 11.0 | 2.2 | Free carbon crystallized |
| | H | Cermet | — | 11.0 | 5.0 | 36.0 | 18.0 | 7.2 | 8.3 | — | — | — | — | — | — | 11.5 | 3.0 | Free carbon precipitated |
| Comparative vane materials | I | Cermet | — | 18.0 | 5.0 | 35.5 | 16.0 | 8.0 | 6.0 | 2.0 | — | — | — | — | — | 7.0 | 2.5 | Binding phase exceeded |
| | J | Cermet | — | 13.0 | — | 38.0 | 27.5 | 3.5 | — | 3.0 | — | — | — | — | — | 13.0 | 2.0 | Carbon exceeded |
| | K | Cermet | — | 13.0 | — | 38.0 | 30.0 | 3.5 | 1.0 | 3.0 | — | — | — | — | — | 10.0 | 2.5 | Large particle size (x = 3 μm) |
| | L | High-speed steel (SKH51) | Remaining | — | — | — | 6.5 | 5.0 | — | — | 4.2 | 2.0 | — | — | — | 0.85 | — | |
| | M | Ceramic ($Al_2O_3$ base) | — | — | — | — | — | — | — | — | — | — | — | — | 100.0 | — | — | |
| | N | Carbon | — | — | — | — | — | — | — | — | — | — | — | 2.0 | — | 98.0 | — | |
| | O | PVD coating (CrN thin film) | Remaining | — | — | — | 6.5 | 5.0 | — | — | 4.2 | 2.0 | — | — | — | 0.85 | — | Mother material element |
| | P | Ni-P plating | Remaining | — | — | — | 6.5 | 5.0 | — | — | 4.2 | 2.0 | — | — | — | 0.85 | — | Mother material element |
| | Q | Fe-base sintered material | Remaining | 0.1 | — | — | — | 2.0 | — | — | 7.4 | — | — | — | — | 1.55 | — | |

Cermet alloys No. A through No. H, which were used for wear resistant cermet alloy vanes for alternate flon of the present invention, and cermet alloys No. I through No. K, which were used for comparison vanes, were fabricated in the following manner. As powder material of carbide, nitride, carbonitride and metal elements was crushed by wet mixing, and granulation was performed by using a spray dryer. Then, the resultant compound was formed by a press into a shape similar to a vane (a near-net shape), and the resultant structure was sintered at 1400° C. in a vacuum furnace. The obtained structure was ground by a diamond wheel to provide a final vane product. No. L is high-speed steel SKH51 that was obtained in a predetermined shape by a plastic deformation process from a flat square bar which is produced either by a hot forging, a hot rolling, or a cold drawing from an ingot casting obtained by a smelting in the atmosphere, and then heated and ground, and the final product was employed as the vane No. L. $Al_2O_3$-base ceramic and Al impregnating carbon, which are available on the market, were ground, and the resultant materials were used for the respective vanes of materials No. M and No. N. For the vane of No.

0, the high-speed steel SKH51 No. L was used as the base material, and a CrN coating was formed thereon with a thickness of 5 μm to 10 μm by a PVD coating. Similarly, for the vane of No. P, a Ni-P plating was performed on the SKH51 No. L. For No. Q, Fe-Crbase powder material was formed into a near-net shape by a press, and sintered in a vacuum furnace. The resultant material was treated by heating and then ground.

To conduct the wear test, the following procedures were employed. A disk made of a Meehanite cast iron (NCM) that corresponded to a piston material, was rotated. While this was being done, the final vane product was pressed against the disk at a constant load so that the disk and the piston slid against each other, and the amount of wear and the friction coefficient were measured. For the test condition, a polyolester oil in which HFC134a, a representive one of the HFC-base flon, was dissolved was used to fill a test tank, and the portions of the vane and the disk that were sliding against each other were completely immersed in this oil. The conditions maintained during the sliding were a pressing load of 150 kgf, an oil temperature of 110° C., and a rotation speed of 1.5 m/s.

The obtained results are shown in Table 3.

The cermet alloys No. A through No. H were the vane materials according to the present invention; No. A through No. F were cermet alloys with no free carbon; and No. G and No. H were cermet alloys in which free carbon was crystallized or precipitated.

TABLE 3

| Categories | No. | Wear Amount (mm) Vane | Wear Amount (mm) Disk | Friction Coefficient |
|---|---|---|---|---|
| Present invention vane materials | A | 0.22 | 0.18 | 0.020 |
| | B | 0.15 | 0.28 | 0.012 |
| | C | 0.18 | 0.25 | 0.015 |
| | D | 0.20 | 0.23 | 0.020 |
| | E | 0.15 | 0.28 | 0.013 |
| | F | 0.25 | 0.18 | 0.030 |
| | G | 0.25 | 0.15 | 0.010 |
| | H | 0.28 | 0.13 | 0.010 |

TABLE 3-continued

| Categories | No. | Wear Amount (mm) Vane | Wear Amount (mm) Disk | Friction Coefficient |
|---|---|---|---|---|
| Comparative vane materials | I | 0.40 | 0.25 | 0.030 |
| | J | 0.30 | 0.40 | 0.010 |
| | K | 0.35 | 0.45 | 0.030 |
| | L | 0.60 | 0.06 | 0.060 |
| | M | 0.10 | 0.70 | 0.050 |
| | N | 0.80 | 0.10 | 0.060 |
| | O | 0.15 | 0.20 | 0.020 |
| | P | 0.30 | 0.30 | 0.030 |
| | Q | 0.70 | 0.08 | 0.070 |

As for the sliding characteristic in the presence of HFC-base flon, it is apparent that the vane materials No. A through No. F were excellent in the wear resistance and in the friction coefficient, compared with No. L (high-speed steel) and No. Q (Fe-base sintering material). Because of the effect of free carbon, the friction coefficients for No. G and No. H are lower than that of for the coated product No. 0, and are excellent in low aggressivity relative to other materials. The vane material No. 1, for which the amount of binding phase exceeded the limited value, shows a considerably low wear resistance. The vane material of No. J, for which the rate of C exceeded the limited value, exhibits considerably high aggressivity relative to other materials. Further, the vane material No. K, for which the hard phase core size exceeded the limited value, was excessively worn by the falling off of the hard phase core.

What is claimed is:

1. A vane made of wear resistant cermet alloy for alternate flon comprising: 5 to 20% by weight of a binder phase composed mainly of Ni; a hard phase having a double phase structure having a core composed mainly of titanium carbide, titanium nitride and/or titanium carbonitride, and a rim phase encircling said core; and inevitable impurities; said hard phase containing 30 to 60% by weight of Ti, 10 to 30% by weight of W, 0.5 to 10% of Mo, 1 to 25% by weight of at least one of Ta, Nb, Cr, V and Zr, 2 to 5.4% by weight of N and 4 to 12% by weight of C, and being uniformly dispersed in an alloy phase; and further, an average core size of said core being 1.5 μm or less and a maximum core size of said core being 5 μm or less.

2. A vane made of wear resistant cermet alloy for alternate flon according to claim 1, wherein said binding phase is composed of 5 to 20% by weight of Ni and Co as primary elements, and a ratio of Ni contained in said binding phase is 50% or more by weight.

3. A vane made of wear resistant cermet alloy for alternate flon according to claim 1, wherein free carbon is crystallized or precipitated in said cermet alloy.

4. A wear resistant cermet alloy vane for alternate flon according to claim 2, wherein free carbon is crystallized or precipitated in said cermet alloy.

* * * * *